US007025228B2

(12) United States Patent
Cuisinier

(10) Patent No.: US 7,025,228 B2
(45) Date of Patent: Apr. 11, 2006

(54) SEPARABLE TOY GUN

(76) Inventor: Jarret Peter Cuisinier, 6730 E. Hermosa Vista Dr., #74, Mesa, AZ (US) 85215

( * ) Notice: Subject to any disclaimer, the term of this patent is extended or adjusted under 35 U.S.C. 154(b) by 232 days.

(21) Appl. No.: 10/640,507

(22) Filed: Aug. 12, 2003

(65) Prior Publication Data

US 2005/0072412 A1 Apr. 7, 2005

(51) Int. Cl.
*A63H 3/18* (2006.01)

(52) U.S. Cl. ..... 222/79; 222/143; 446/473

(58) Field of Classification Search ..... 222/78, 222/79, 143; 446/69, 400, 401, 405, 406, 446/473

See application file for complete search history.

(56) References Cited

U.S. PATENT DOCUMENTS 4,260,077 A * 4/1981 Schroeder ..... 222/137
5,241,944 A * 9/1993 Rappaport ..... 124/67
5,261,852 A * 11/1993 Ejima ..... 446/405
5,740,948 A * 4/1998 Chu et al. ..... 222/175
6,279,562 B1 8/2001 Clayton

* cited by examiner

*Primary Examiner*—Joseph A. Kaufman

(57) ABSTRACT

The present invention provides a separable toy gun configuration capable of being split into multiple, independently operable toy guns. For example, a toy gun has two housings integrated via a connector. Each of these housings further includes a controller (e.g. trigger) and, while connected, these controllers are jointly operable. However, the user can separate the two housings into two independent and operable toy guns.

20 Claims, 5 Drawing Sheets

SEPARABLE TOY GUN

FIELD OF INVENTION

This invention relates to children entertainment devices, and more particularly, to children entertainment devices such as toy guns.

BACKGROUND OF THE INVENTION

A variety of toy gun devices have been described in the prior art. These devices can have configurations ranging from play guns, which can emit sounds and lights when a trigger is pulled, to water guns and projectile guns (e.g. foam darts guns, ball guns, and the like). Such gun configurations typically have a barrel, a housing, a handle, and a controller, which is commonly in the form of a lever trigger. In addition, these guns can further include supplementary components and features (e.g. automated magazine systems).

However, these toy guns have inherent limits in their flexibility of use. First, only one person can use such a toy gun at a time. Thus, if two children wish to play and only one child has a gun, little fun can be had (especially by the child without a gun). Furthermore, while there have been some advancements in "firepower" with double barrel embodiments and guns with multiple nozzles (see U.S. Pat. No. 6,279,562 to Clayton), such guns often can have diminished launching capability as their power is frequently diluted over multiple discharge ports.

Accordingly, a toy gun configuration that can optionally be used and enjoyed by multiple children at one time is desirable. In addition, a toy gun that is able to aptly deliver greater firepower is as well desirable.

SUMMARY OF THE INVENTION

The present invention provides a separable toy gun configuration capable of being split into multiple, independently operable toy guns. In accordance with an exemplary embodiment of the present invention, a toy gun has two housings integrated via a connector. Each of these housings further includes a controller (e.g. trigger) and, while connected, these controllers are integrated so as to be jointly operable. However, when desirable, the user can separate the two housings into two independent and operable toy guns, each having its own controller.

BRIEF DESCRIPTION OF THE DRAWINGS

Additional aspects of the present invention will become evident upon reviewing the non-limiting embodiments described in the specification taken in conjunction with the accompanying figures, wherein like numerals designate like elements, and.

DETAILED DESCRIPTION

The following descriptions are of preferred exemplary embodiments only, and are not intended to limit the scope, applicability, or configuration of the invention in any way. Rather the following description provides a convenient illustration for implementing a preferred embodiment of the invention. Various changes may be made in the function and arrangement of elements described in the preferred embodiments without departing from the spirit and scope of the invention as set forth herein.

Generally, in accordance with a preferred embodiment of the present invention, a separable toy gun is disclosed. The device is suitably configured to be separable into multiple, independently operable toy guns. In accordance with an exemplary embodiment of the present invention, a toy gun has two housings integrated via a connector. Each of these housings further includes a controller (e.g. trigger) and, while connected, these controllers are integrated so as to be jointly operable. However, when desirable, the user can separate the two housings into two independent and operable toy guns, each having its own controller.

However, in accordance with an alternative embodiment of the present invention, the device could be suitably configured to have other overlapping functions in addition to the controllers. For example, the device could be composed of connected pressurized water guns wherein the pressurizing means (e.g. pump handles) are further overlapping and jointly operable.

Figure 1A:
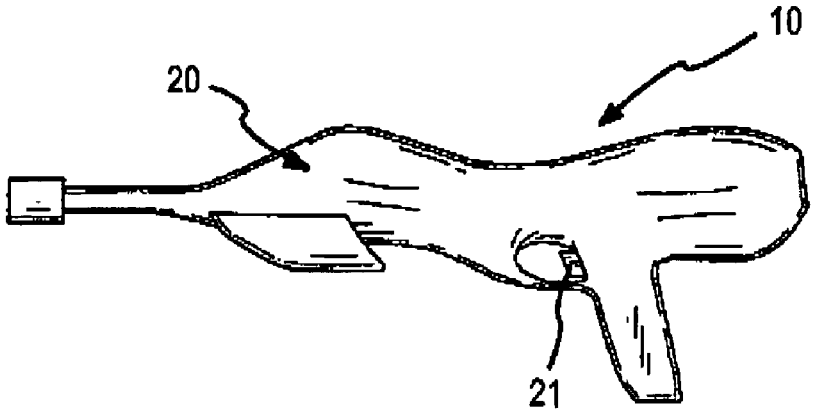
FIG. 1*a* is a side view of a connected preferred embodiment.
Figure 1B:
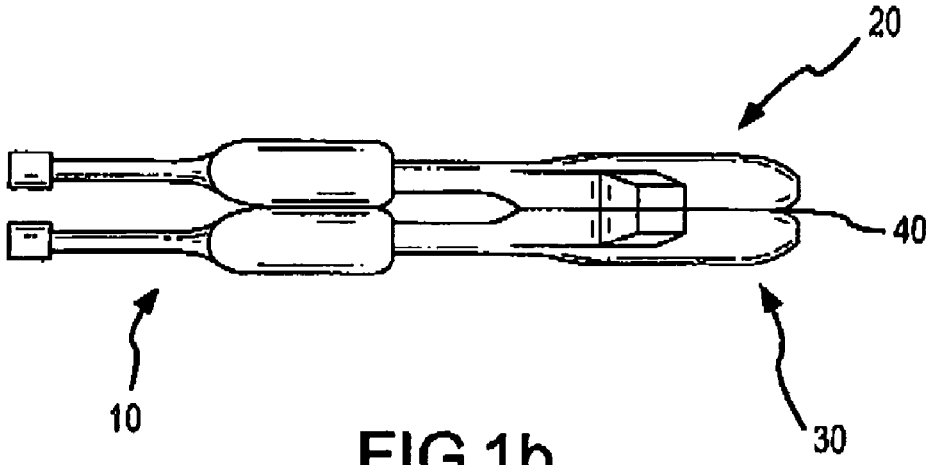
FIG. 1*b* is a bottom view of a connected preferred embodiment.
Figure 1C:
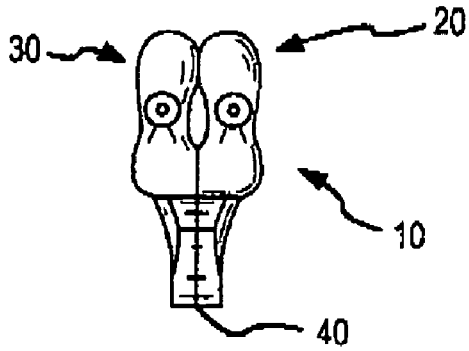
FIG. 1*c* is a front view of a connected preferred embodiment.

Thus, with reference to FIG. 1*a*, FIG. 1*b*, and FIG. 1*c*, in accordance with a preferred embodiment of the present invention, a separable toy gun 10 is shown having a first gun housing 20, a second gun housing 30, and a connector 40. Connector 40 is preferably a double horizontal slide lock, thereby providing a secure and reusable connection between first gun housing 20 and second gun housing 30. For example, connector 40 could be composed of two slide locks, each possessing a raised projection (male end) that interlocks with corresponding channel (female end). However, and in accordance with various alternate embodiments, connector 40 could be composed of any number of such locks or of a variety of other connectors (e.g. clips, adhesives, push-button locking systems, and the like) now known or as yet unknown.

Furthermore, and in accordance with another alternative embodiment of the present invention, connector 40 could be standardized so as to allow first gun housing 20 and second gun housing 30 to be connected with a variety of other gun housings. Likewise, connector 40 could be present on both sides of first gun housing 20 and second gun housing 30 so as to ensure connectability with other toy gun housings using male and female type connector 40. Again in accordance with a preferred embodiment, first gun housing 20 and second gun housing 30 also possess a first controller 21 and a second controller 31 respectively. These controllers 21 and 31 regulate the functionality of the device. For example, a water gun controller would likely control the release of water while a basic play gun controller might control light or sound release. Moreover, these controllers can come in a variety of shapes and sizes depending on both design and functional needs.

In accordance with a preferred embodiment of the invention, first gun housing 20 and second gun housing 30 are simple polymer toy guns that are similar in function, form, and size. However, in accordance with various alternate embodiments of the present invention, a variety of toy gun types, shapes, and sizes could be integrated with each other so long as their controllers can still be jointly operated when the gun housings are connected. For example, embodiments could incorporate various combinations of differently (or similarly) sized and shaped toy projectile guns (e.g. foam dart guns, suction-cup dart guns, disc guns, ball guns, water balloon launchers, and the like), water guns, water balloon filling guns, play guns producing sounds or lights, and the like. Furthermore, these gun housings could be composed of a variety of parts and materials (including polymers, composites, metals, and the like) as required for the chosen functionality of the gun housing. Moreover, and again in accordance with various alternate embodiments, the number of first gun housing 20, second gun housing 30, and connector 40 could as well vary. For example, separable toy gun 10 could consist of a greater number of gun housings all with, while connected, overlapping and jointly operable controllers.

Figure 2A:
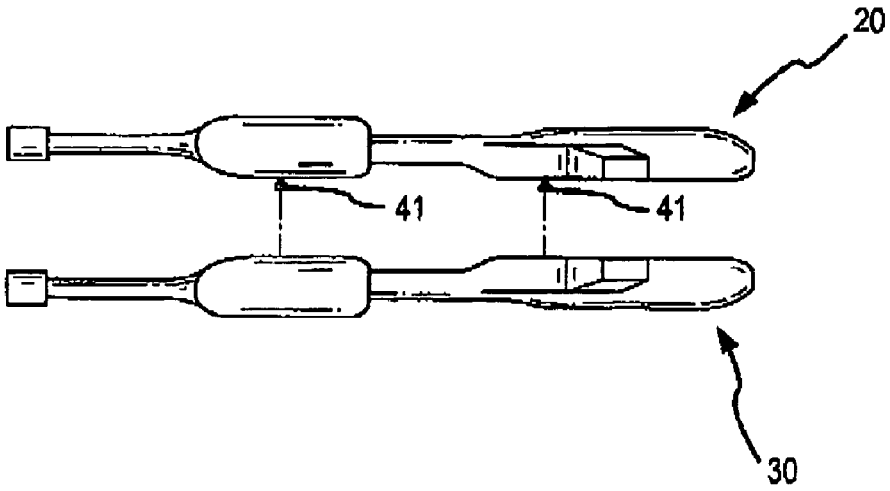
FIG. 2*a* is a bottom view of a separated preferred embodiment.
Figure 2B:
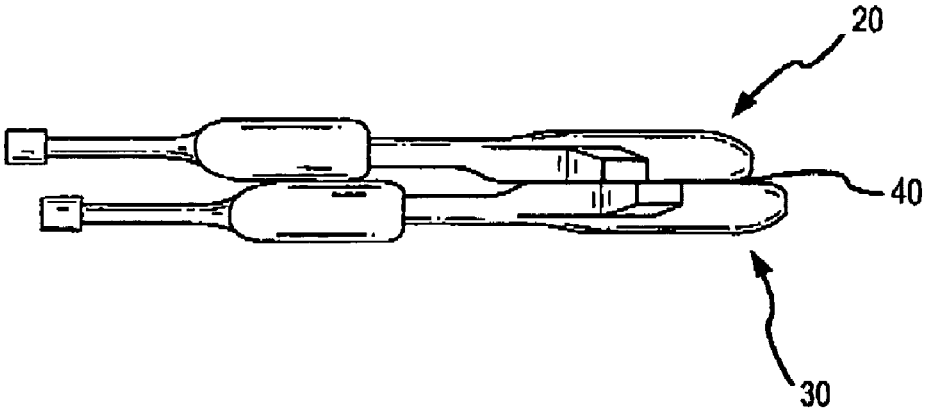
FIG. 2*b* is a bottom view of a preferred embodiment being connected.

Thus, in accordance with the present exemplary embodiment of the invention and now in reference to FIG. 2*a* and FIG. 2*b*, a user can connect separable toy gun 10. While separated (see FIG. 2*a*), a user or multiple users can use either first gun housing 20 or second gun housing 30 as independent and functional toy guns. When desirable, however, a user can further connect first gun housing 20 and second gun housing 30 together via connector 40. In accordance with one aspect a preferred embodiment and now with further reference to FIG. 2*b*, connector 40 is a horizontal double slide lock with two male ends 41. Male ends 41 enter into two female ends 43 (not shown) when controller 21 and controller 31 are not aligned (see FIG. 2*b*). The user then slides wide-ended male ends 41 horizontally into contracting channel female ends 42 until controller 21 and controller 31 align and first gun housing 20 and second gun housing 30 are effectively locked together. While connected (see FIG. 1*b*), first gun housing 20 and second gun housing 30 preferably create an enhanced, "double-barreled" toy gun with augmented functionality.

However, in accordance with alternate embodiments, first gun housing 20 and second gun housing 30 could be shaped in such a way as if they created a complete embodiment when connected. For example, first gun housing 20 and second gun housing 30 could be fashioned as two halves (though both still functional) of a complete gun. Thus, when first gun housing 20 and second gun housing 30 are connected, the two halves form a complete, and not "double", toy gun embodiment.

Furthermore, and again in accordance with a preferred embodiment, when first gun housing 20 and second gun housing 30 are connected the user can jointly use aligned controller 21 and controller 31. Thus, the user can utilize the functionality of both first gun housing 20 and second gun housing 30 at the same time. For example and in the case of a simple play gun, both first gun housing 20 and second gun housing 30 could emit sounds. When jointly used, they could then emit double the sound or even utilize planned overlapping rhythmic melodies. However, in accordance with another aspect of a preferred embodiment, controller 21 and controller 31 do not align in such a manner as to be only jointly operable. Instead, while connected separable water gun 10 can preferably still be operated as independent first gun housing 20 and second gun housing 30, as well as connected separable water gun 10. Alternatively, the user can at any time reverse the connection process to again separate first gun housing 20 and second gun housing 30, again yielding two independent and functional toy guns.

In accordance with various alternate embodiments, the number, shape, and function of the gun housings of separable toy gun 10 can vary as desired. However, in all embodiments the controller of separable toy gun 10 overlap in such a way so as to be jointly operable.

Figure 3:
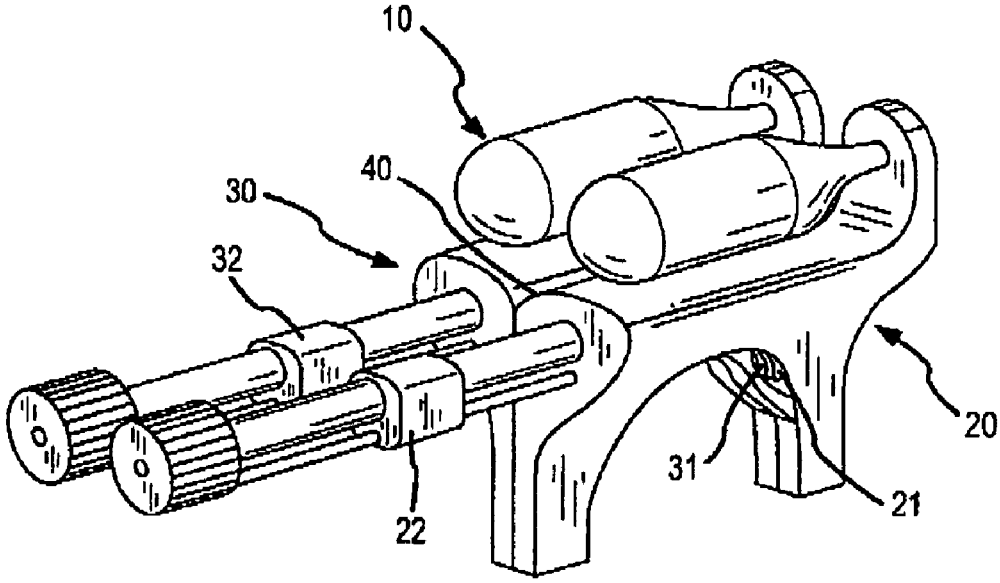
FIG. 3 is a perspective view of an exemplary embodiment for pressurized water guns.

Now, with reference to FIG. 3, an exemplary embodiment for a pressurized water gun is presented. While connected, separable toy gun 10 is able to jointly issue two streams of pressurized water. In accordance with one aspect of the present exemplary embodiment, first gun housing 20 and second gun housing 30 each further possess a pressurizing means 22 and a pressurizing means 32 respectively. Preferably, when separable toy gun 10 is connected, pressurizing means 22 and pressurizing means 32 overlap in a manner similar to controller 21 and controller 31, thereby allowing them to be jointly operable. Optionally, joint operability between pressurizing means 22 and pressurizing means 32 may be enhanced via connector 40. In this case, connector 40 may be present as a supplementary and local male/female slide lock or as any other connector already described in the prior art. However, in accordance with an alternate embodiment of the present invention, separable toy gun 10 could possess only one pressurizing means for multiple water gun housings. Thus, while connected the gun housing possessing the pressurizing means could pressurize the other, dependent gun housings. Then, the dependent gun housings could be used in combination or could be separated and used until they again required pressurizing.

Figure 4:
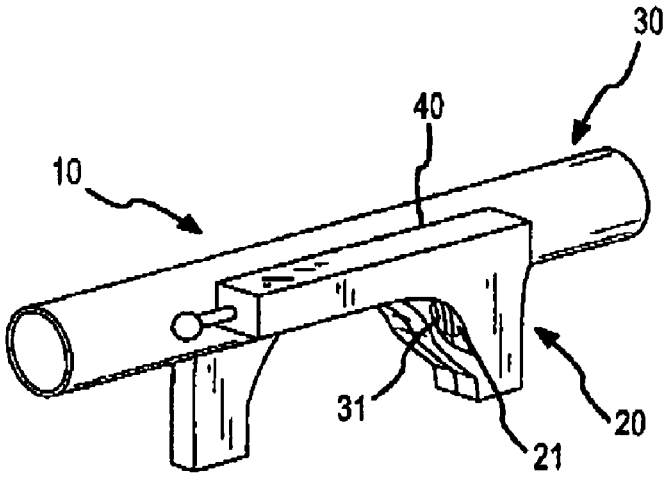
FIG. 4 is a perspective view of an embodiment for projectile launching guns.

Referring now to FIG. 4, in accordance with another alternative embodiment of the present invention, an exemplary embodiment for a projectile gun is presented. In accordance with one aspect of the present exemplary embodiment, first gun housing 20 is a ball gun while second gun housing 30 is a smaller suction-cup dart gun. As with the other embodiments, controller 21 and controller 31 again overlap in a manner so as to be jointly operable. Furthermore, separable toy gun 10 could also possess jointly operable "cocking" mechanisms.

Figure 5:
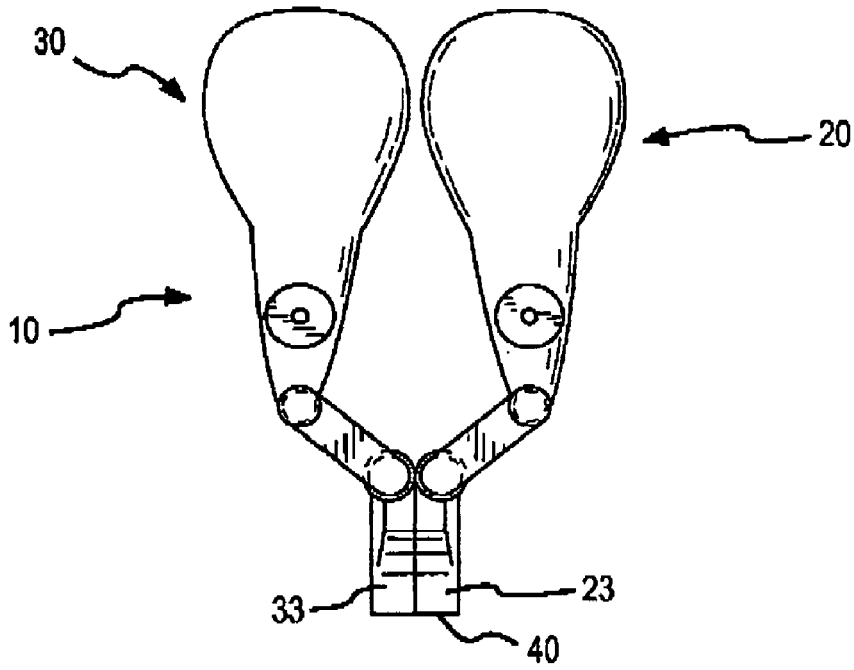
FIG. 5 is a front view of an exemplary embodiment where the handles pivot so as to help the connection of the housings.

With reference now to FIG. 5, another alternate embodiment of the invention is presented. In accordance with the present embodiment of the invention, a configuration possessing moving gun housing parts is disclosed. These gun housing parts move in a manner so as to make the connection of first gun housing 20 and second gun housing 30 easier and to make connected separable toy gun 10 easier to use. Furthermore, such moving parts allow gun housing 20 and gun housing 30 to have larger widths than otherwise possible. In accordance with the present embodiment of the invention, a handle 23 of first gun housing 20 and a handle 33 of second gun housing 30 pivot (in this case, along two pivot points) in a manner such that connected separable toy gun 10 is easier to grasp. However, in accordance with various alternate embodiments of the present invention, first gun housing 20 and second gun housing 30 could have any number of pivots points or could move in other manners with similar effects. Furthermore, and again in accordance with other alternative embodiments, only one of the housings of separable toy gun 10 could have moving parts for this purpose. Moreover, separable toy gun 10 could have more than two housings and these housings could move in similar manners so as to allow them be connectable in both combinations of two joined housings or multiple joined housings.

Figure 6:
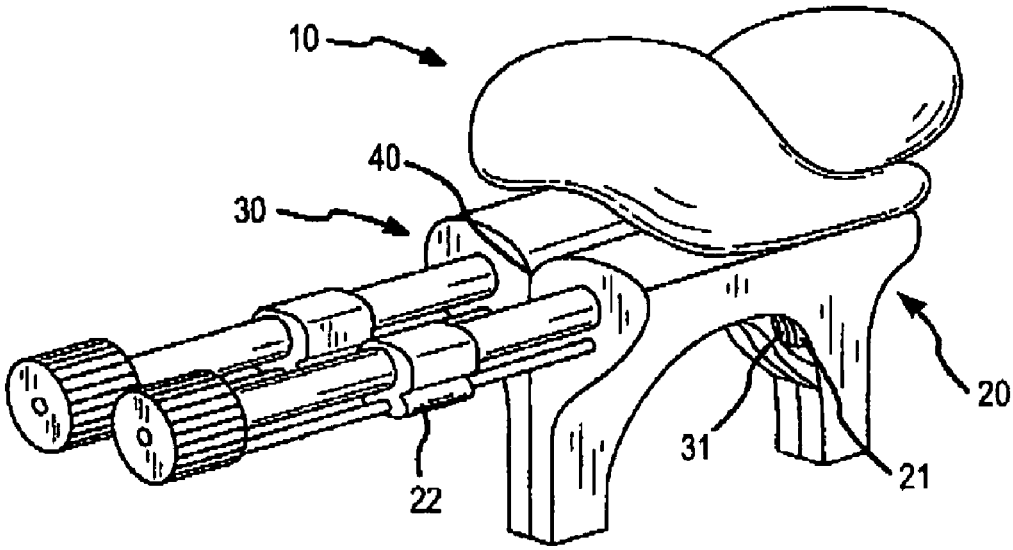
FIG. 6 is a perspective view of an exemplary embodiment where the housings intertwine.

Referring now to FIG. 6, and in accordance with another alternative embodiment of the present invention, an embodiment with intertwining first gun housing 20 and second gun housing 30 is presented. Such intertwining housings not only creates a sense of completeness to connected separable toy gun 10, but also eases stress on connector 40 as pressure is distributed across a greater surface area.

Figure 7A:
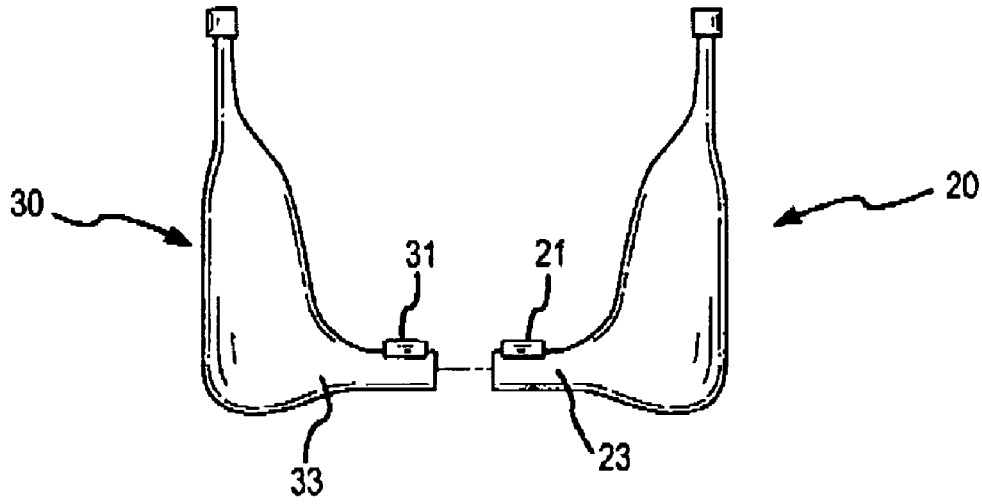
FIG. 7*a* is a side view of a separated embodiment where the housings connect at the base of the handles; and, FIG. 7*b* is a side view of a connected embodiment where the housings connect at the base of the handles.
Figure 7B:
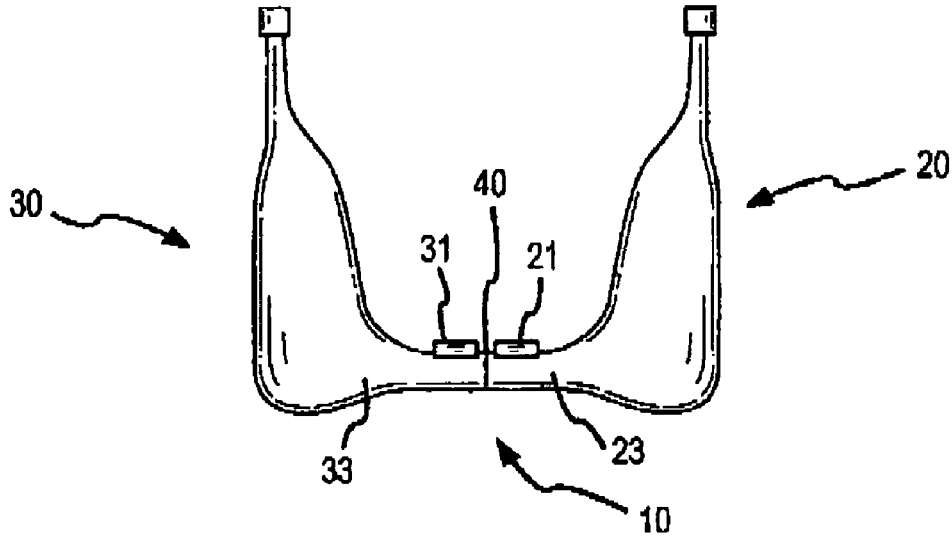

Now with reference to FIG. 7*a* and FIG. 7*b*, another alternate embodiment of the invention is presented. First gun housing 20 and second gun housing 30 connect via connector 40 at the base of handle 23 and handle 33. Adjacent controller 21 and controller 31 are still jointly operable while first gun housing 20 and first gun housing 30 are connected.

Thus, while the principles of the invention have been described in illustrative embodiments, many combinations and modifications of the above-described structures, arrangements, proportions, the elements, materials, and components, used in the practice of the invention in addition to those not specifically described may be varied and particularly adapted for a specific environment and operating requirement without departing from those principles.

I claim:

1. A separable toy gun device, comprising:

at least two independently operable toy guns, each gun further comprising:

a barrel, a housing, a handle, and a controller, wherein said toy guns are connectable via a connector and wherein said controllers of each gun meet in a parallel manner so as to be jointly operable.

2. The separable toy gun device of claim 1, wherein said connector is located on opposing sides of said housings.

3. The separable toy gun device of claim 2, wherein said connector comprises male and female slide locks.

4. The separable toy gun device of claim 1, wherein said connectors are located on both sides of each of said toy gun housings.

5. The separable toy gun device of claim 1, wherein said connector is located on bases of said toy guns.

6. The separable toy gun device of claim 1, wherein said toy guns are pressurized water guns, wherein each has independent pressurizing means.

7. The separable toy gun device of claim 6, wherein said pressurizing means are jointly operable when said toy guns are connected.

8. The separable toy gun device of claim 1, wherein said toy guns are projectile guns having cocking means.

9. The separable toy gun device of claim 8, wherein said cocking means are jointly operable when said toy guns are connected.

10. The separable toy gun device of claim 1, wherein each of said toy guns comprises a pressurized water gun, wherein at least one of said toy guns has a reservoir pressurized by a pressurizing means of another toy water gun.

11. The separable toy gun device of claim 1, wherein each controller is operable independently of one another when said toy guns are connected.

12. The separable toy gun device of claim 1, wherein said toy gun handles pivot to facilitate the connection of said toy guns.

13. The separable toy gun device of claim 1, wherein said toy gun handles pivot such that while said toy guns are connected the resulting combined width of said handles is less than the unpivoted combined width of said handles.

14. The separable toy gun device of claim 1, wherein said toy guns are intertwined when connected.

15. The separable toy gun device of claim 1, wherein said toy guns resemble a single gun when connected.

16. The separable toy gun device of claim 1, wherein a first gun produces a first sound, and a second gun produces a second sound, and wherein said first and second sounds complement each other when said first and second guns are jointly operated.

17. The separable toy gun device of claim 1, wherein a first gun produces a first light, and a second gun produces a second light, and wherein said first and second lights complement each other when said first and second guns are jointly operated.

18. The separable toy gun device of claim 1, wherein a first gun further comprises a first moving part and wherein a second gun further comprises a second moving part, wherein said moving parts move in a complementary fashion when said first and second guns are jointly operated.

19. The separable toy gun device of claim 18, wherein said moving parts comprise an automated barrel.

20. A separable toy gun device, comprising:

at least two independently operable toy guns, each gun further comprising:

a barrel, a housing, a handle, and a controller, wherein said toy guns are connectable via a connector and wherein said controllers of each gun are independently operable when connected.

* * * * *